US008607468B2

(12) United States Patent
Hillebrandt

(10) Patent No.: US 8,607,468 B2
(45) Date of Patent: Dec. 17, 2013

(54) LAYING AID FOR TILES

(76) Inventor: Wolfgang Hillebrandt, Welver (DE)

( * ) Notice: Subject to any disclaimer, the term of this patent is extended or adjusted under 35 U.S.C. 154(b) by 111 days.

(21) Appl. No.: 13/260,652

(22) PCT Filed: Sep. 30, 2010

(86) PCT No.: PCT/EP2010/005953
§ 371 (c)(1),
(2), (4) Date: Sep. 27, 2011

(87) PCT Pub. No.: WO2011/000582
PCT Pub. Date: Jan. 6, 2011

(65) Prior Publication Data

US 2012/0023766 A1 Feb. 2, 2012

(30) Foreign Application Priority Data

Sep. 30, 2009 (DE) ..... 10 2009 043 465

(51) Int. Cl.
*G01B 3/30* (2006.01)
*G01D 21/00* (2006.01)

(52) U.S. Cl.
USPC ..... 33/527

(58) Field of Classification Search
USPC ..... 33/526, 527, DIG. 20
See application file for complete search history.

(56) References Cited

U.S. PATENT DOCUMENTS

| | | | | | |
|---|---|---|---|---|---|
| 2,930,135 | A * | 3/1960 | Rodtz, Sr. | ..... | 33/518 |
| 3,548,505 | A * | 12/1970 | Di Candilo | ..... | 33/527 |
| 3,861,098 | A * | 1/1975 | Schaub | ..... | 52/98 |
| 4,835,924 | A * | 6/1989 | Blacklin et al. | ..... | 52/263 |
| 5,288,534 | A * | 2/1994 | Tavshanjian | ..... | 33/526 |
| 5,359,783 | A * | 11/1994 | Smith | ..... | 33/527 |
| 6,625,951 | B1 * | 9/2003 | McCarthy | ..... | 33/527 |
| 6,874,242 | B2 * | 4/2005 | Shilo et al. | ..... | 33/526 |
| 7,257,926 | B1 * | 8/2007 | Kirby et al. | ..... | 33/526 |
| 7,536,802 | B1 * | 5/2009 | Tavy et al. | ..... | 33/527 |
| 2004/0060184 | A1 * | 4/2004 | Shilo et al. | ..... | 33/526 |
| 2009/0126213 | A1 * | 5/2009 | Tavy et al. | ..... | 33/527 |
| 2009/0235548 | A1 * | 9/2009 | Higgs et al. | ..... | 33/526 |
| 2012/0023766 | A1 * | 2/2012 | Hillebrandt | ..... | 33/527 |

* cited by examiner

*Primary Examiner* — Yaritza Guadalupe-McCall
(74) *Attorney, Agent, or Firm* — North Weber & Baugh LLP

(57) ABSTRACT

The invention relates to a device (1) used as a laying aid for tiling work, comprising a base element (7, 8) having a support region (12) for laying flat on a surface to be covered with tiles (16), and a tile-supporting region (2) on which tiles (16) are placed. The tile-supporting region (2) has at least two web-like spacer elements (9) which extend perpendicularly with respect to a plane defined by the tile-supporting region (2) and which are arranged at an angle of an integer multiple of 90° relative to one another in said plane, and which have a thickness (10) corresponding to a desired joint spacing. To avoid the disadvantages of the known laying aids and to achieve uniform joint spacing and an even surface, whereby the laying aid is intended to be especially easy to handle, the base element (7, 8) is designed as a disk-like element having a base area that is smaller than a base area of the tiles (16) to be laid.

4 Claims, 5 Drawing Sheets

LAYING AID FOR TILES

CROSS REFERENCE TO RELATED APPLICATIONS

This application is the National Phase Application under 35 USC §371 of International Application No. PCT/EP2010/005953, filed Sep. 30, 2010, which claims priority to German Patent Application 10 2009 043 465.8, filed Sep. 30, 2009.

BACKGROUND

A. Technical Field

The present invention relates to a device used as a laying aid for tile work, comprising a base element having a support region for laying flat on a surface to be covered with tiles, and a tile-supporting region on which tiles are placed, the tile-supporting region having at least two web-like spacer elements which extend perpendicularly with respect to a plane defined by the tile-supporting region and which are arranged at an angle of an integer multiple of 90° relative to one another in said plane, and which have a thickness corresponding to a desired joint spacing.

B. Background of the Invention

Laying aids of the above-mentioned type for tile work are used to simplify laying of wall or floor tiles so that a uniform laying pattern having uniform joint widths between the tiles may be achieved. In the present context, the term "tiles" is understood to mean all types of tiles and/or plates for walls and/or floors, made of various materials including glass, natural stone, ceramic, or metal. In addition, within the scope of the invention the surface to be covered with tiles may be a floor as well as a wall. In the simplest case, known laying aids are designed as jointing crosses, wedges, or the like, and are used to maintain equal joint widths. The known laying aids are inserted as spacers into the joints between the tiles. A disadvantage of the known jointing crosses is that they do not provide stability during the laying, i.e., before the tile grout sets. A further disadvantage of this simplest previously known type of laying aid for tile work is that it does not assist in achieving evenness of the tile covering.

Therefore, a laying aid for tiles is known from DE 82 35 842 U1, having a lattice whose lattice bars fix the tiles, so that the individual lattice cells formed between the lattice bars have the same size as the tiles. Reinforcing webs run transversely through the lattice cells, either diagonally or parallel with respect to the lattice bars. Using this known laying aid for tile work, in comparison to simple jointing crosses, for example, the tiles are laid flat, since the reinforcing webs specify a laying plane. In addition, sliding of the laying aid during laying is prevented due to the mass of the tiles placed on the laying aid. However, in these known laying aids it is disadvantageous that they are very inconvenient to use, since by principle they must extend over the dimensions of multiple tiles. A further disadvantage is that this known laying aid may even have to have a surface which corresponds to the floor to be laid, which is particularly inconvenient. In addition, the large-surface structure of the known laying aid has the disadvantage that large regions of the tiles or plates to be laid are not wetted by adhesive due to the fact that they are covered by the reinforcing webs running diagonally or parallel with respect to the lattice bars. This may disadvantageously result in insufficient bonding and adhesion of the tiles to the subsurface.

Lastly, a laying aid for tile work is known from DE 29 604 286 U1, which is essentially composed of an interwoven lattice made of a finely meshed net in which jointing crosses having the grid dimensions of the tiles are arranged. It is stated that the known interwoven lattice achieves a strong, durable connection with the subsurface, and the interwoven lattice provides additional reinforcement. A disadvantage of this known laying aid for tile work is that it, too, may be impractical to use due to the dimensions, which correspond to the surface area of multiple tiles, or even to the entire area to be laid. In addition, use of the interwoven lattice, which runs continuously between the floor and the underside of the tiles, entails the risk that adhesion of the tiles to the floor may be impaired due to the fact that the wetting of the tiles with tile adhesive is interrupted.

SUMMARY OF THE INVENTION

On the basis of the overall prior art, the object of the present invention is to provide a device as a laying aid for tile work, in which uniform joint spacing and evenness are achieved while avoiding the disadvantages of the known laying aids, the laying aid being particularly convenient to use.

According to the invention, for a device of the type mentioned at the outset which is used as a laying aid for tile work, this object is achieved in that the tile-supporting region is designed as a disk-like element having a base area which is smaller than a base area of the tiles to be laid. Thus, according to the invention it is provided that the undersides of the tiles are placed on the laying aid according to the invention essentially only in the edge or corner regions. According to the invention, a compact laying aid is thus obtained, independent of the size of the tiles to be laid, which has a maximum diameter of 10 cm, for example. As a result of this design, it is ensured according to the invention that most of the underside of the tiles is wetted with adhesive or grout in order to establish a firm connection with the subsurface. In the ideal case, wetting of up to 100% of the underside of the tiles is achieved by using the invention. However, precise laying of the tiles with uniform joint spacing and evenness is still ensured, since the device according to the invention is fixed in the tile-supporting region due to the mass of the tile. Multiple tiles are advantageously placed at their corner or edge regions on the same device in order to align with one another.

Handling of the laying aid according to the invention is particularly convenient in one embodiment of the invention in which the disk-like element is circular. The circular shape also provides an optimum, on the one hand with regard to fixing the device due to the mass of the tiles placed on the tile-supporting region of the device, and on the other hand with regard to a bottom surface of the tiles, not covered by the laying aid, which bears the largest possible amount of grout or adhesive. In the present context, a circular, disk-like element is understood to mean any disk-like element having an essentially circular outer contour. However, within the scope of the invention, elements having a semicircular and/or quarter-circular shape are also included in the term.

In another embodiment of the invention, the disk-like element may also have a polygonal, in particular triangular and/or quadrilateral and/or pentagonal, outer contour.

In one advantageous embodiment of the invention, the surface area of the tiles which is wettable by grout or tile adhesive is further enlarged when the support region has at least one cutout.

To provide a stackable design for the devices according to the invention as a laying aid for tile work, one preferred embodiment of the invention provides that a first extension of the cutout corresponds to at least one length of the spacer element, and a second extension of the cutout corresponds to at least the thickness of the spacer element. According to this embodiment of the invention, it is possible to stack the devices according to the invention one on top of the other by placing a second device on a first device in such a way that the spacer element of the first device projects through the cutout in the second device. When the cutout is appropriately dimensioned, in particular when the second extension of the cutout corresponds to a multiple of the thickness of the spacer element, multiple devices, or as many devices as desired, may thus be stacked on top of one another. The stackability is of great practical advantage in particular for laying the tiles.

Another advantageous embodiment of the invention provides that the spacer elements are arranged separately without contacting one another. For example, instead of intersecting spacer elements in the manner of a customary spacer cross, the configuration of the spacer elements may be selected so that the intersection point of the joints on the tile-supporting region defined by the spacer elements is not covered by a spacer element. In this case, in this intersection point a cutout may be formed in the tile-supporting region in order to bring the tile grout or tile adhesive in the region of this joint intersection point into direct contact with the subsurface, in the interest of the bonding strength of the joint.

According to another advantageous embodiment of the invention, the spacer elements have a basic trapezoidal shape, the side facing the tile-supporting region being larger than the side facing away. This design simplifies insertion of the spacer elements into cutouts of further devices for the purpose of stacking.

The same objective is achieved in another embodiment of the invention in which the edges of the spacer elements are rounded.

As a result of the measure that the support region and/or the tile-supporting region has in particular pointed, knob-like elevations, inadvertent displacement of the laying device according to the invention relative to the subsurface and/or shifting of the tiles with respect to the laying aid is/are effectively avoided.

The measure that the disk-like element has at least one predetermined breaking edge for breaking out a segment which includes at least one spacer element allows this special design of the device according to the invention for laying tiles to be easily provided, without tools. For example, the base element may be broken into two halves without tools, using predetermined breaking edges, in order to use one of the halves on a wall or edge region of the surface to be covered with tiles, since in this region only two tiles adjoin one another. Similarly, the predetermined breaking edges may be configured in such a way that it is possible to break out one-fourth of the disk-like element, so that the remaining disk-like element has a 90° internal angle. A device provided in this manner may advantageously be used in corner regions in which only three tiles to be laid adjoin one another.

Lastly, a configuration of predetermined breaking edges may be provided which allows a segment having a 90° external angle to be broken out of the disk-like element. This "quarter element" may advantageously be inserted at edges in border regions in which a corner of a tile adjoins only at the walls, but does not adjoin other tiles. This is the case, for example, for an inside corner.

In particular in one preferred embodiment of the invention, the predetermined breaking edge may be situated on a straight line which extends through the midpoint of the disk-like element. The segments which may be broken out thus have symmetry with respect to the disk-like element.

In one refinement of the invention, manufacture as a mass-produced product is particularly cost-effective when the device according to the invention is manufacturable in the injection molding process.

In another advantageous embodiment of the invention, the laying aid device is formed from an essentially inflexible and/or transparent plastic material, in particular ABS, PC, SAN, or polystyrene. When a transparent material is selected in one preferred embodiment of the invention, according to the invention this has the advantage that the laying aid, which is intended to remain in the finished tiled surface, is essentially invisible, even when a transparent joint compound such as silicone is used. The plastics polystyrene, acrylonitrile butadiene styrene (ABS), polycarbonate (PC), and styrene acrylonitrile (SAN) are characterized by high surface hardness, resistance to customary tile adhesives, and a high modulus of elasticity, for example in the range of 2000 MPa and greater.

BRIEF DESCRIPTION OF THE DRAWINGS

The invention is described by way of example in one preferred embodiment, with reference to the drawing; further advantageous particulars of the figures are contained in the drawing.

Functionally equivalent parts are provided with the same reference numerals.

The figures of the drawing show the following:

FIG. 1 shows a perspective view of one embodiment of the laying aid according to the invention, in an oblique view from the top;

FIG. 2 shows a section along line II-II, through the laying aid according to FIG. 1;

FIG. 3 shows a top view of various design variants of the laying aid according to the invention;

FIG. 4 shows a schematic illustration of the use of various embodiments of the laying aid according to the invention in conjunction with (a) a tile composite and (b) a tile offset;

FIG. 5 shows a stack composed of 80 laying aids according to FIG. 1 stacked on top of one another, (a) in a side view and (b) in a top view.

DETAILED DESCRIPTION OF THE PREFERRED EMBODIMENTS

Figure 1:
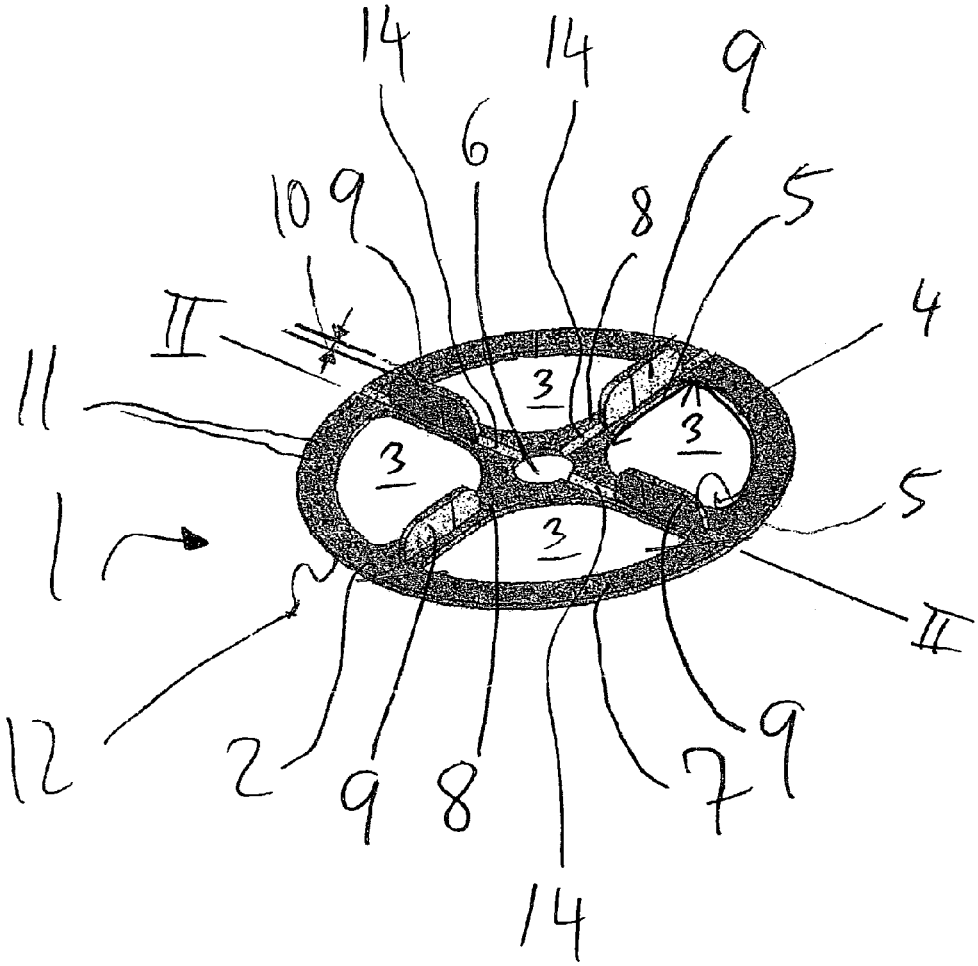

FIG. 1 shows a perspective view, in an oblique angle from the top, of one preferred embodiment of a laying aid 1 according to the invention, having a tile-supporting region 2. Overall, the laying aid 1 has a disk shape with a circular contour. The tile-supporting region 2 is interrupted by four identical cutouts 3. The cutouts 3 essentially have the shape of a sector of a circle, i.e., a circular surface, which is delimited by a circular arc 4 and two circle radii 5. The corners of the circular sector are rounded.

A circular cutout 6 is present in the center of the laying aid 1. Thus, the tile-supporting region 2 is composed of an annular section 7 and four spoke-like sections 8 which are oriented at an angle of 90° relative to one another. A spacer web 9 is situated on each spoke-like section 8. Each spacer web 9 is situated at the level of the cutouts 3 in the radial direction with respect to the spoke-like section 8. The height of each spacer web 9 extends perpendicularly to the plane defined by the tile-supporting region 2. The thickness 10 of each spacer web 9 is selected corresponding to a desired joint width of the tile surface to be laid. The tile-supporting region 2 formed from the spoke-like sections 8 and the annular section 7 may be made of polystyrene, ABS, PC, or SAN, and in one preferred embodiment is transparent. The entire tile-supporting region 2 has pointed knobs 11. The underside of the laying aid 1, not visible in FIG. 1, is the support region 12 with which the laying aid 1 is placed on the subsurface to be covered with tiles. This is identifiable in the sectional view according to FIG. 2, described in greater detail below.

Figure 2:
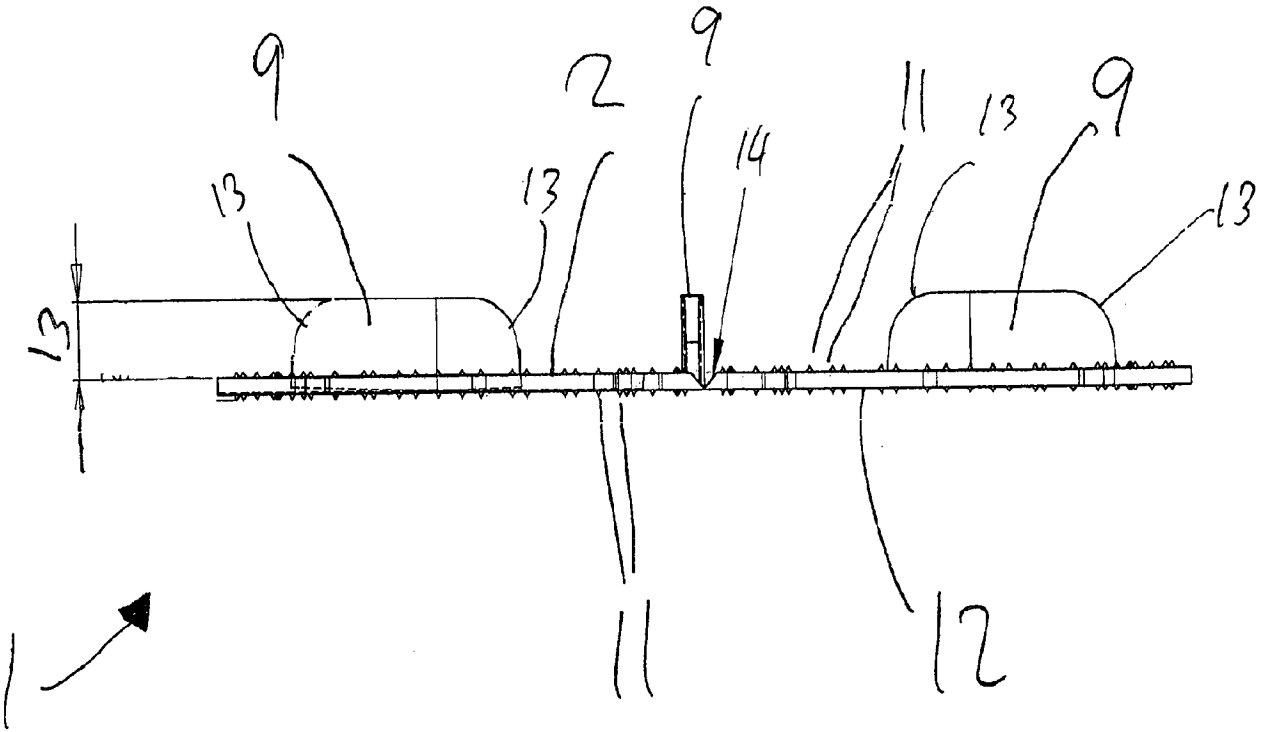

As identified particularly well in FIG. 2, which shows a cross section of the laying aid 1 according to FIG. 1 along line II-II, the spacer webs 9 have a height 13 with respect to the tile-supporting region 2. The height 13 of the spacer webs 9 is advantageously selected so that it is less than the thickness of the tiles to be laid.

As shown in FIG. 2, the support region 12 is also provided with pointed knobs 11. The spacer webs 9 are rounded at the corners 13, on the side facing away in the tile-supporting region 2.

It is also shown in FIG. 2 that the tile-supporting region 2 has a predetermined breaking edge 14, which in the sectional view according to FIG. 2 appears as a notch-like depression. As shown in FIG. 1, according to the exemplary embodiment described here the laying aid 1 has a predetermined breaking edge 14 at three adjacent spoke-like sections 8 of the tile-supporting region 2. The predetermined breaking edge 14 extends in each case in the longitudinal direction of the spoke-like distance 8, i.e., in the radial direction relative to the circular disk-shaped laying aid 1, starting from an outside region of the annular section 7 and continuing to the circular cutout 6 in the center of the laying aid 1. The spacer webs 9 are each slightly offset, relative to the radial positions, in parallel to the edges of the predetermined breaking edges 14.

Figure 3:
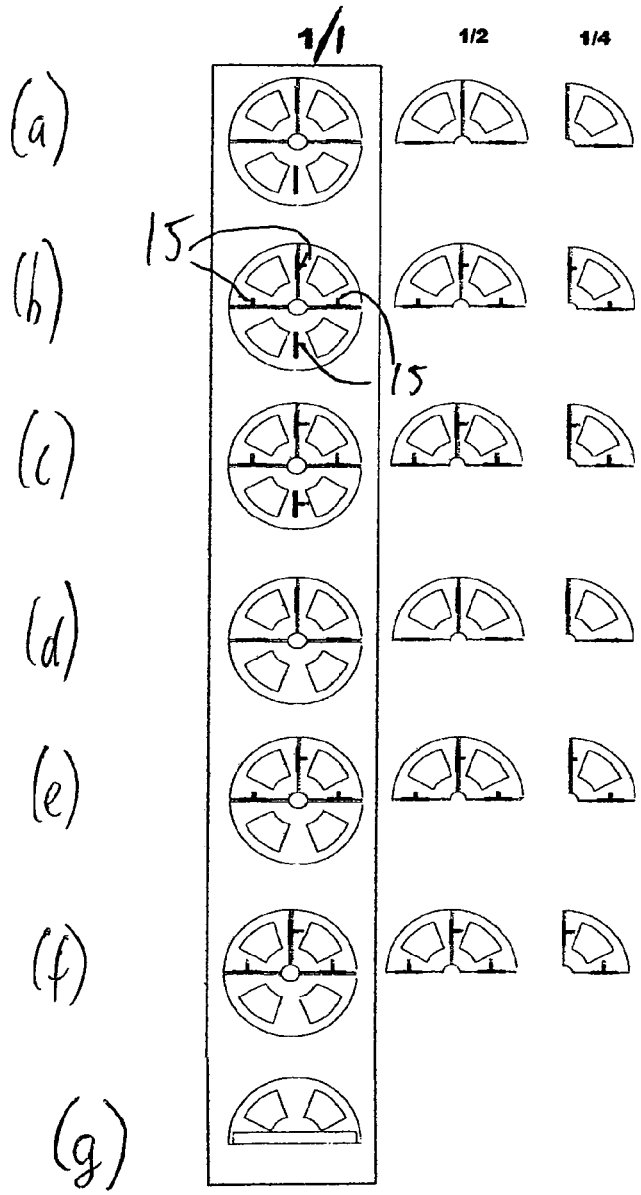

FIG. 3 illustrates, based on various design variants of the laying aid according to the invention, the uses which are obtainable by means of the laying aid 1 according to the invention, without tools, with the aid of the predetermined breaking edges 14. FIG. 3 is structured as a matrix; various design variants of the laying aid 1 according to the invention are shown in lines (a), (b), . . . , (g) in the first column highlighted by a border and denoted by column heading 1/1. The columns with headings 1/2 and 1/4 show the base design of the laying aid 1 according to the invention shown in column 1/1 in which the laying aid 1 has been modified by breaking out segments along the predetermined breaking edges 14, without tools. The laying aids 1 are each shown in the top view of the tile-supporting region 2. The variant shown in line (a), column 1/1 is suitable for laying tiles in a composite joint, four spacer webs 9 having a given thickness being provided. This basic shape may be converted, without tools, to a laying aid 1 having a semicircular basic shape by breaking off the lower circular segment along the predetermined breaking edge 14, the segment obtained now having only three spacer webs 9. Compared to the basic shape according to column 1/1, in which four tiles may be aligned with one another, the segment according to column 1/2 is suitable for aligning two tiles with one another, and at an end wall. The device according to the invention is likewise usable for tiles and plates of all sizes and made of any material.

Lastly, the quarter circle-like segment according to column 1/4 is obtained by breaking the element according to column 1/2 along the predetermined breaking edge 14. This segment now has only two spacer webs 9, which are situated at a 90° angle relative to one another.

Lines (b) and (c) in FIG. 3 show modifications of the basic shape according to line (a), and differ from the basic shape according to (a), 1/1 in that the spacer webs 9 have a spacer knob 15. The spacer knob 15 extends parallel to the plane of the tile-supporting region 2, at a right angle to the end face of the spacer webs 9. On account of the spacer knobs 15, the effective thickness of the spacer webs 9 is increased when tiles are placed on the spacer webs 9, resulting in a larger joint width of the laid tiles.

The design according to line (c) in FIG. 3 differs from that according to line (b) in that the spacer knobs 15 are longer, resulting in a correspondingly larger joint width.

Line (d), column 1/1 in FIG. 3 shows a base embodiment of the laying aid 1 according to the invention which has only three spacer webs 9, each oriented at a 90° angle relative to one another. This embodiment is suitable for laying tiles in an offset joint, in which three tiles adjoin one another in each case.

The variants according to lines (e) and (f) in FIG. 3 once again differ from the basic shape according to line (d) by virtue of the spacer knobs 15 for producing a greater effective thickness 10 of the spacer webs 9, which results in a greater joint width.

Line (g) in FIG. 3 shows in the single column 1/1 a design variant of the device according to the invention which is particularly suited for use as a base element when laying tiles and/or plates on a wall. According to this design variant, the device has a semicircular shape with a spacer web 9 along the straight edge.

Figure 4:
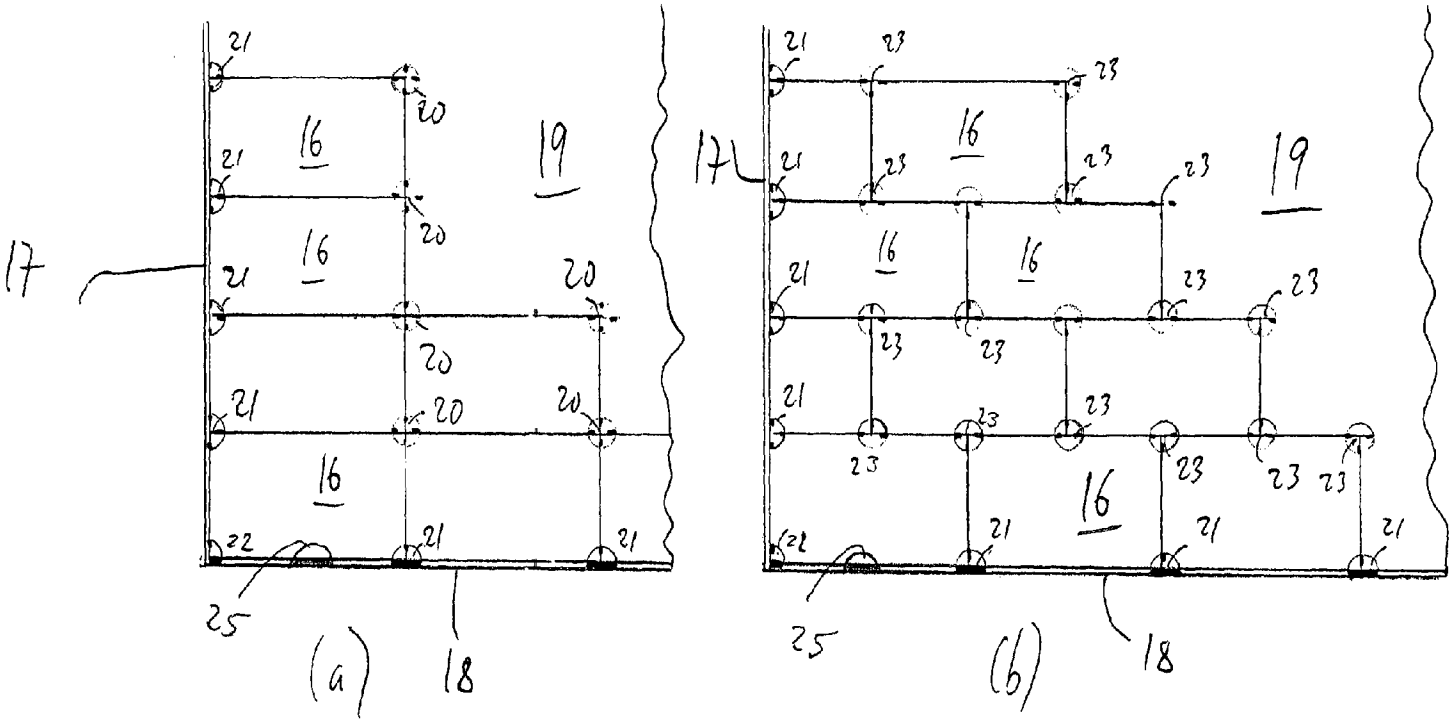

FIG. 4 illustrates the use of different embodiments of the laying aid 1 according to the invention for laying tiles. The schematic illustration in part (a) of FIG. 4 shows the uses for the so-called composite joint, whereas part (b) of FIG. 4 shows the conditions for an offset joint. In FIG. 4, the tiles are denoted by reference numeral 16 in each case. In both parts of the figure, in each case a vertical wall border 17 delimits the side, and a horizontal floor border 18 delimits the bottom, of the surface 19 to be covered with tiles 16.

In the composite joint patterns shown in FIG. 4(*a*), in each case four tiles 16 adjoin one another at their corner regions at positions 20. Laying aids 1 according to one of lines (a), (b), (c) of column 1/1 in FIG. 3 may be used at these positions 20, depending on the desired joint width.

At positions 21, in each case two tiles 16 adjoin one another as well as the wall border 17. The designs from the basic shapes according to column 1/1 which are obtained by breaking along the predetermined breaking edges 14 in one of the designs according to lines (a), (b), or (c) in FIG. 3 may be used in these positions 21, depending on the desired joint width.

Position 22 is characterized by the meeting of the wall border 17 and the floor border 18 at a tile 16. The designs obtained according to column 1/4 in one of the variants according to lines (a), . . . , (f), starting from the embodiments shown in column 1/1 in FIG. 3 and twice breaking off segments along the predetermined breaking edges 14, may be used in such a corner position 22, depending on the desired joint spacing.

In the case of the joint offset laying technique shown in FIG. 4(*b*), once again positions 21 are characterized by two adjacent tiles 16 which meet at the vertical wall border 17. The designs according to FIG. 3 which may be used in these positions 21 correspond to those described in conjunction with the composite joint according to FIG. 4(*a*).

Likewise, position 22 is characterized by the meeting of one corner of a tile 16 with the vertical wall border 17 on the one hand and with the floor border 18 on the other hand; the embodiments of the laying aid according to FIG. 3 which may be used in these positions 22 correspond to those described in conjunction with FIG. 4(*a*) for the composite joint.

Lastly, for laying the tiles 16 in the offset joint as shown in FIG. 4(*b*), positions 23 are characterized by the meeting of two tiles 16 at the corners and with an additional tile 16 at one edge. The designs according to column 1/2 in FIG. 3 may be used in these regions, as well as in the case of positions 21, depending on the desired joint width.

In both FIG. 4(*a*) and FIG. 4(*b*), the use of the embodiment of the invention according to FIG. 3(*g*) in position 25 is shown. As is apparent, the embodiment is used as a base between the floor and wall attachment when tiles or plates are laid at a wall. The embodiment is used along the lower edge of a plate or tile in order to hold same in a specified joint spacing relative to the floor.

Figure 5:
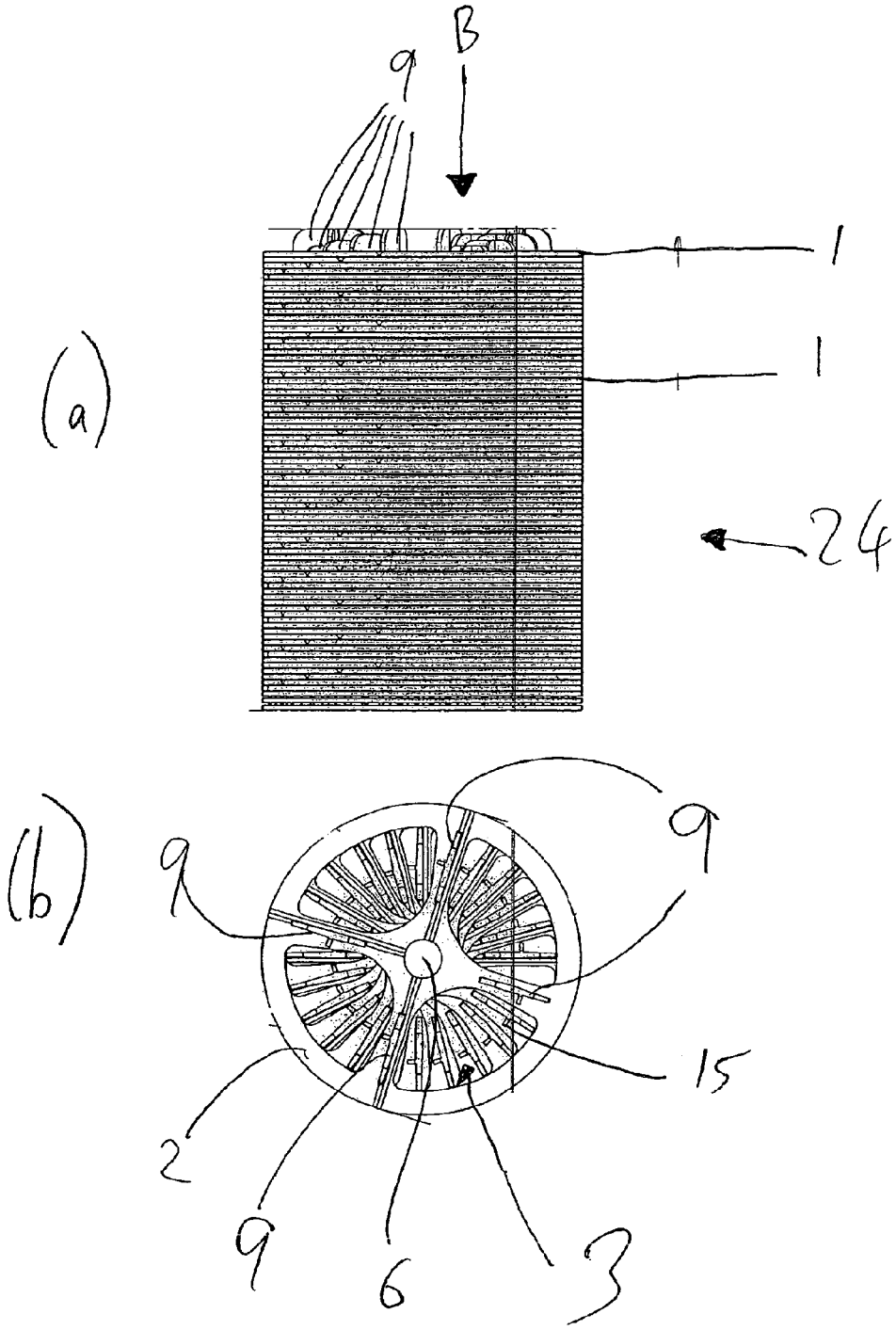

FIG. 5 illustrates the stackability of the embodiment of the laying aid 1 according to the invention shown in FIG. 1. FIG. 5(*a*) shows a side view of a "tower" composed of 80 laying aids 1 according to FIG. 1 which are vertically stacked on top of one another. FIG. 5(*b*) shows a top view of the tower 24 according to FIG. 5(*a*) in the viewing direction of arrow B. It is apparent that the stackability is based on the fact that the spacer webs 9 are insertable into the cutouts 3 of the particular laying aid 1 thereabove. Each additional laying aid 1 is rotated about the vertical with respect to the laying aid 1 on which it is placed in order to allow positioning of the spacer webs 9 and spoke-like sections 8. This stackability is based on the fact that the cutouts 3 are shaped in such a way that they are able to accommodate the spacer webs 9 with regard to the radial extension as well as with regard to their thickness 10.

What is claimed is:

1. A device as a laying aid for tile work, comprising a base element that further comprises:

a support region for laying flat on a surface to be covered with tiles;

a tile-supporting region on which tiles are placed, the tile-supporting region having at least two web-like spacer elements that extend perpendicularly with respect to a plane defined by the tile-supporting region, and arranged at an angle of an integer multiple of 90° relative to one another in said plane, and have a thickness corresponding to a desired joint spacing;

wherein the base element is designed as a disk-like element having a base area that is smaller than a base area of the tiles to be laid, and the support region or the tile-supporting region has pointed, knob-like elevations; and wherein the disk-like element has at least one predetermined breaking edge for breaking out a segment which includes at least one web-like spacer element.

2. A device as a laying aid for tile work, comprising a base element that further comprises:

a support region for laying flat on a surface to be covered with tiles;

a tile-supporting region on which tiles are placed, the tile-supporting region having at least two web-like spacer elements that extend perpendicularly with respect to a plane defined by the tile-supporting region, and arranged at an angle of an integer multiple of 90° relative to one another in said plane, and have a thickness corresponding to a desired joint spacing;

wherein the base element is designed as a disk-like element having a base area that is smaller than a base area of the tiles to be laid;

wherein a first extension of a cutout in the tilt support region is associated with a length of the at least two web-like spacer element, and a second extension of the cutout is associated with a thickness of the spacer element; and wherein the at least two web-like spacer elements have a basic trapezoidal shape, and the side facing the tile-supporting region is larger than the side facing away; and wherein the disk-like element has at least one predetermined breaking edge for breaking out a segment which includes at least one web-like spacer element.

3. A device as a laying aid for tile work, comprising a base element that further comprises:

a support region for laying flat on a surface to be covered with tiles;

a tile-supporting region on which tiles are placed, the tile-supporting region having at least two web-like spacer elements that extend perpendicularly with respect to a plane defined by the tile-supporting region, and arranged at an angle of an integer multiple of 90° relative to one another in said plane, and have a thickness corresponding to a desired joint spacing;

wherein the base element is designed as a disk-like element having a base area that is smaller than a base area of the tiles to be laid, and the support region or the tile-supporting region has pointed, knob-like elevations; and wherein a predetermined breaking edge is included in the disk-like element and located on a straight line which extends through the midpoint of the disk-like element.

4. A device as a laying aid for tile work, comprising a base element that further comprises:

a support region for laying flat on a surface to be covered with tiles;

a tile-supporting region on which tiles are placed, the tile-supporting region having at least two web-like spacer elements that extend perpendicularly with respect to a plane defined by the tile-supporting region, and arranged at an angle of an integer multiple of 90° relative to one another in said plane, and have a thickness corresponding to a desired joint spacing;

wherein the base element is designed as a disk-like element having a base area that is smaller than a base area of the tiles to be laid;

wherein a first extension of a cutout in the tilt support region is associated with a length of the at least two web-like spacer element, and a second extension of the cutout is associated with a thickness of the spacer element; and wherein the at least two web-like spacer elements have a basic trapezoidal shape, and the side facing the tile-supporting region is larger than the side facing away; and wherein a predetermined breaking edge is included in the disk-like element and located on a straight line which extends through the midpoint of the disk-like element.

* * * * *